US010682881B2

(12) United States Patent
Taylor et al.

(10) Patent No.: US 10,682,881 B2
(45) **Date of Patent: *Jun. 16, 2020**

(54) ANTLER WALL MOUNT ASSEMBLY

(71) Applicants: Royce Taylor, Clyde, TX (US); Sheryl Taylor, Clyde, TX (US); Jacob Thomas, Clyde, TX (US); Geneva Thomas, Clyde, TX (US)

(72) Inventors: Royce Taylor, Clyde, TX (US); Sheryl Taylor, Clyde, TX (US); Jacob Thomas, Clyde, TX (US); Geneva Thomas, Clyde, TX (US)

(73) Assignee: GAME RIDGE, LLC, Clyde ( * ) Notice: Subject to any disclaimer, the term of this patent is extended or adjusted under 35 U.S.C. 154(b) by 0 days.

This patent is subject to a terminal disclaimer.

(21) Appl. No.: 15/912,653

(22) Filed: Mar. 6, 2018

(65) Prior Publication Data

US 2018/0257423 A1 Sep. 13, 2018

Related U.S. Application Data

(63) Continuation-in-part of application No. 15/456,754, filed on Mar. 13, 2017.

(51) Int. Cl.

| | |
|---|---|
| ***A47G 35/00*** | (2006.01) |
| ***B44C 5/02*** | (2006.01) |
| ***F21V 33/00*** | (2006.01) |

(52) U.S. Cl.

CPC ..... *B44C 5/02* (2013.01); *F21V 33/0028* (2013.01)

(58) Field of Classification Search

None

See application file for complete search history.

(56) References Cited

U.S. PATENT DOCUMENTS

| | | | |
|---|---|---|---|
| 3,319,922 | A | 5/1967 | Christensen |
| 4,464,440 | A | 8/1984 | Dotzman |
| 5,472,765 | A | 12/1995 | Green |
| 8,512,045 | B2 | 8/2013 | Bittner |
| 8,758,023 | B2 | 6/2014 | Bittner |
| 2006/0154224 | A1 | 7/2006 | St. Ama |
| 2008/0069977 | A1 | 3/2008 | McAbee |
| 2012/0107634 | A1 | 5/2012 | Swarthout |
| 2013/0014373 | A1 | 1/2013 | Jordan |

(Continued)

OTHER PUBLICATIONS

Christy's Coop Signs, BA-Beer Season Bottle Opener, 2016 (Year: 2016).*

(Continued)

*Primary Examiner* — Seth Dumbris
*Assistant Examiner* — Kim S. Horger
(74) *Attorney, Agent, or Firm* — Decker Jones P.C.; Brian K. Yost; Geoffrey Mantooth

(57) ABSTRACT

An assembly for mounting deer antlers is provided, the assembly generally comprising an enclosure, the enclosure generally shaped like a long neck bottle or liquor bottle, and comprising a front portion and a rear portion, the enclosure being adapted to couple end portions of main beams of the antlers to an inside surface of the enclosure rear portion such that portions of the antlers extend through lateral holes, to an area outside the enclosure, the enclosure front and rear portions being removably coupled to one another.

10 Claims, 15 Drawing Sheets

(56) References Cited

U.S. PATENT DOCUMENTS

| | | | | |
|---|---|---|---|---|
| 2013/0215617 | A1* | 8/2013 | Carroll | F21V 33/0028 362/253 |
| 2014/0263448 | A1* | 9/2014 | Erskine-Smith | B65D 35/22 222/143 |
| 2015/0258844 | A1 | 9/2015 | Byrns | |
| 2016/0101645 | A1 | 4/2016 | Appel | |
| 2017/0087925 | A1* | 3/2017 | Martin | B44C 5/06 |

OTHER PUBLICATIONS

Miller Brewing Company, "Vintage Lighted Miller Lite Longhorn Beer Sign", manufactured Jun. 28, 1989, images from resale by Chairish (Year: 1989).*

Lonestar Western Decor, "Longhorn Wall Mount with Leather Star", product reviewed on Apr. 21, 2014. (Year: 2014).*

* cited by examiner

ANTLER WALL MOUNT ASSEMBLY

This application is a continuation in part of utility application Ser. No. 15/456,754 filed Mar. 13, 2017 and Applicant hereby claims the benefit of said utility application Ser. No. 15/456,754, the contents of which is incorporated by reference herein in its entirety.

BACKGROUND OF THE INVENTION

1. Field of the Invention

The present invention relates generally to a wall mount assembly and specifically to a wall mount assembly that may be used to mount deer antlers.

2. Description of the Prior Art

Over the years, hunters and nature enthusiasts have looked for ways to display deer antlers such as those resulting from a deer's annual shedding process. Various antler display systems and devices are known in the art. For example, U.S. Pat. No. 3,319,922 to Christensen discloses an antler mounting kit with which antlers may be attached to a plaque with spring steel strips. U.S. Pat. No. 4,464,440 to Dotzman and U.S. Pat. No. 5,472,765 to Green disclose mounting systems comprising simulated deer heads to which antlers may be mounted using dowels. U.S. Pat. Nos. 8,512,045 and 8,758,023, both to Bittner, disclose antler mounting kits comprising an artificial deer bodies to which antlers may be attached. U.S. Pat. Pub. No. 2006/0154224, St. Ama discloses a mount to which deer antlers can be attached, replicating the look of a "European" style mount. U.S. Pat. Pub. No. 2008/0069977, McAbee discloses a trophy mount and a method of making a trophy mount using a plaster mold. U.S. Pat. Pub. No. 2012/0107634, Swarthout discloses a deer skull mounting apparatus comprising a decorative display. U.S. Pat. Pub. No. 2013/0014373, Jordan discloses a mounting kit comprising an artificial deer skull. U.S. Pat. Pub. No. 2015/0258844, Byrns discloses an antler mounting kit that uses bark from a tree. U.S. Pat. Pub. No. 2016/0101645, Appel discloses an antler mounting system comprising a metal cutout that serves as a background.

While there are many options for displaying deer antlers that permit the antlers to be displayed either as a part of a simulated deer head or deer body or in connection with an outdoor related background, what is needed is an antler wall mount assembly that permits the user to display antlers in an attractive manner while conveying the user's interest in other sports such as football and baseball or that permits the user to display the antlers as part of a replica of a drinking bottle.

SUMMARY OF THE INVENTION

An assembly for mounting deer antlers is provided, the assembly generally comprising an enclosure, the enclosure generally shaped like a game ball such as a football, or shaped like a drinking bottle and comprising a front portion and a rear portion, the enclosure being adapted to couple end portions of main beams of the antlers to an inside surface of the enclosure rear portion such that portions of the antlers extend through lateral through openings, to an area outside the enclosure, the enclosure front and rear portions being removably coupled to one another.

The front portion of the enclosure comprises a rounded, generally hollow, fusiform configuration such that top and bottom ends are narrower than an equator portion. The front portion comprises a lace-like extension portion which simulates the laces of a standard American football. The lace-like extension portion is formed from a series of vertical and horizontal raised segments. The lace-like extension portion extends vertically such that approximately half the vertical and horizontal raised segments are above the equator portion and half are below.

In certain embodiments, simulated contrasting stripes are positioned near the respective ends of the front portion to simulate the stripes of some standard footballs.

The front portion comprises the lateral openings. The lateral openings are positioned on sides of the front portion proximate to the top end and are adapted to permit the front portion to partially enclose a lower perimeter of the antler main beams. The front and rear portions enclose the lower perimeter when the antlers are positioned within the enclosure and the front and rear portions are secured together.

The rear portion comprises a rear portion outer rim adapted for cooperative coupling with a front portion outer rim. Extending forward from an angled inside perimeter wall of the rear portion are one or more tabs. Each tab is flexible and biased exterior to the respective side of the perimeter wall to which the tab is mounted. The user can bend the tabs inwardly so as to permit the front portion outer rim to be moved against the rear portion outer rim. When released, the tabs return to the exteriorly biased position. When the front portion is mounted to the rear portion the tab's exterior bias applies pressure on an inside surface of the front portion, keeping the front and rear portions coupled together.

Although tabs are used to removably couple the front and rear portions together, other fastening mechanisms known in the art may also be used. For example, the front and rear portions may be coupled together with conventional and commercially available fasteners such as glue, snaps, hook and loop fasteners, threaded couplers (screws, bolts, etc.), pins, detents, and the like.

The rear portion comprises a generally flat rear outer surface which permits the assembly to be easily mounted against a flat wall using standard mounting hardware such as hooks, wires, cleats, nails, screws, and the like.

The inside perimeter wall defines an inside rear wall and interior shelf. The interior shelf is raised with respect to the insider rear wall such that, when the rear portion is mounted to the front portion, the interior shelf is closer to the front portion than the inside rear wall. This interior shelf is the surface to which the antlers are mounted. The interior shelf is adapted to receive a threaded fastener which is driven through a horizontal member of the antlers. The horizontal member can be artificial or natural. The horizontal member, for example, may comprise the skull portion to which the antlers are naturally attached. With respect to sheds, the horizontal portion may comprise wood, plastic, or other suitable material adapted to permit the main beams to be attached.

In another embodiment, the front portion of the enclosure comprises a rounded, generally hollow, semi-spheroid configuration resembling a baseball. In this embodiment, the front portion comprises simulated stitching which simulates the stitching of a standard baseball. The simulated stitching of this embodiment is formed from a series of simulated stitches.

In other embodiments, the assembly comprises a soccer ball configuration when viewed from the front.

In other embodiments, when viewed from the front, the assembly comprises respective configurations of a basketball, a tennis ball, a hockey puck, a golf ball, a volley ball, a bowling pin, and a billiards ball.

In another embodiment, the assembly comprises a vertically elongated and rounded configuration resembling a long neck style drinking bottle.

In another embodiment, the front portion of the enclosure comprises a vertically elongated and angular configuration resembling a liquor bottle.

In some embodiments, the enclosure comprises a light which illuminates the interior of the enclosure and which can be seen from outside the enclosure.

DESCRIPTION OF THE PREFERRED EMBODIMENT

Figure 1:
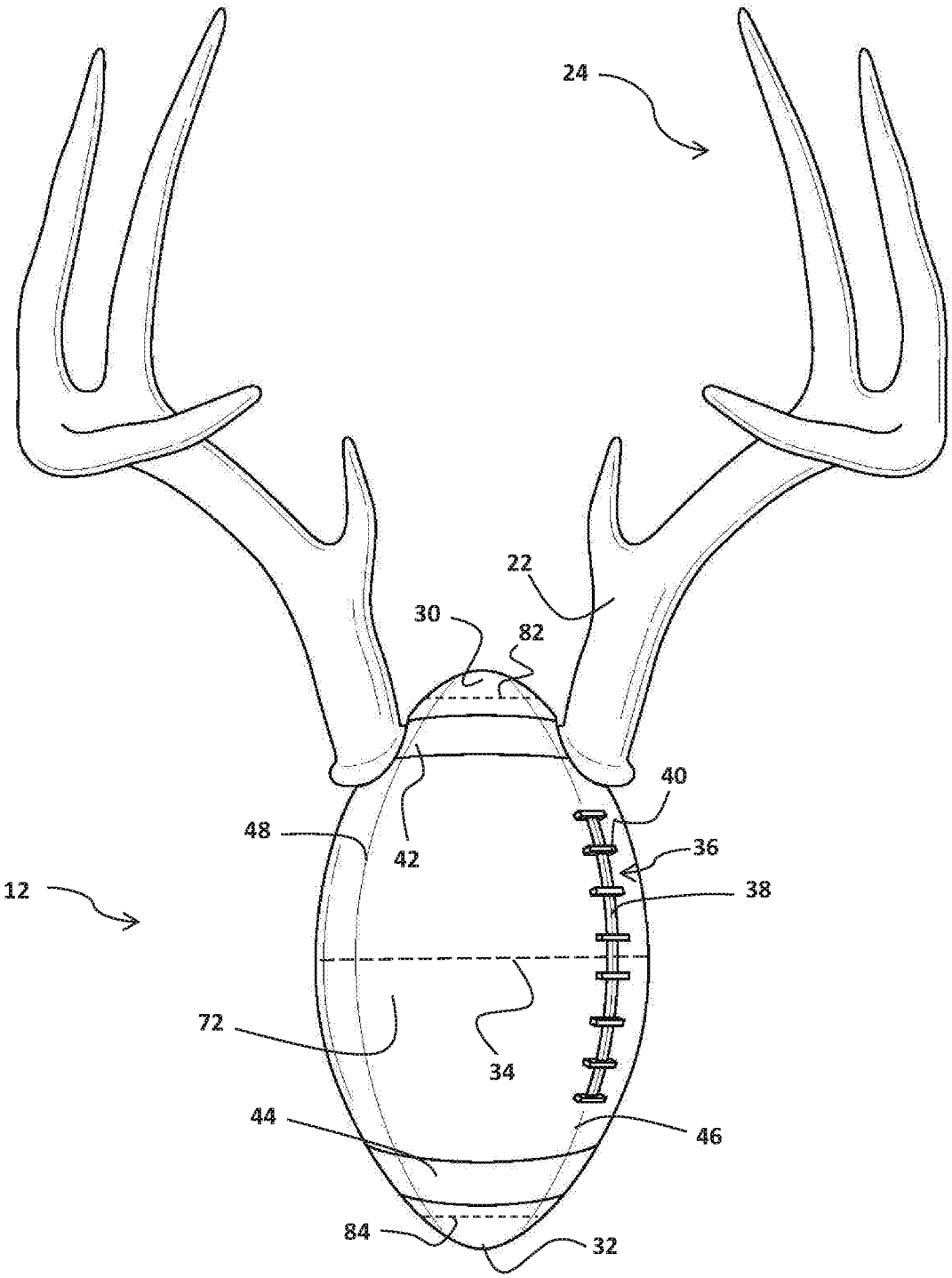
FIG. 1 is a front elevation view of the antler wall mounting assembly, in accordance with a preferred embodiment.

Referring to FIGS. 1-15, there is shown the antler wall mount assembly 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Referring to the figures, the antler wall mount assembly 12 of the preferred embodiment generally comprises an enclosure 14, the enclosure 14 generally shaped like a game ball such as a football, a long neck style drinking bottle, or a liquor bottle and comprising a front portion 16 and a rear portion 18, the enclosure 14 being adapted to couple end portions 20 of main beams 22 of antlers 24, directly or indirectly, to an interior shelf 64 of the enclosure 14 rear portion 18 such that portions of the antlers 24 extend through lateral openings 26, 28, to an area outside the enclosure 14, the enclosure 14 front and rear portions 16, 18, being adapted for removable coupling to one another. The antlers 24 can be antlers from deer, elk, or other ruminant mammals comprising antlers 24 or horns 24. The enclosure is adapted to permit antlers 24 secured from animals taken through hunting or other means or antlers 24 found as a result of a deer's annual shedding ("sheds"). Sheds 24 are found individually such that the main beams 24 are not found attached to a mounting member 68.

Figure 2:
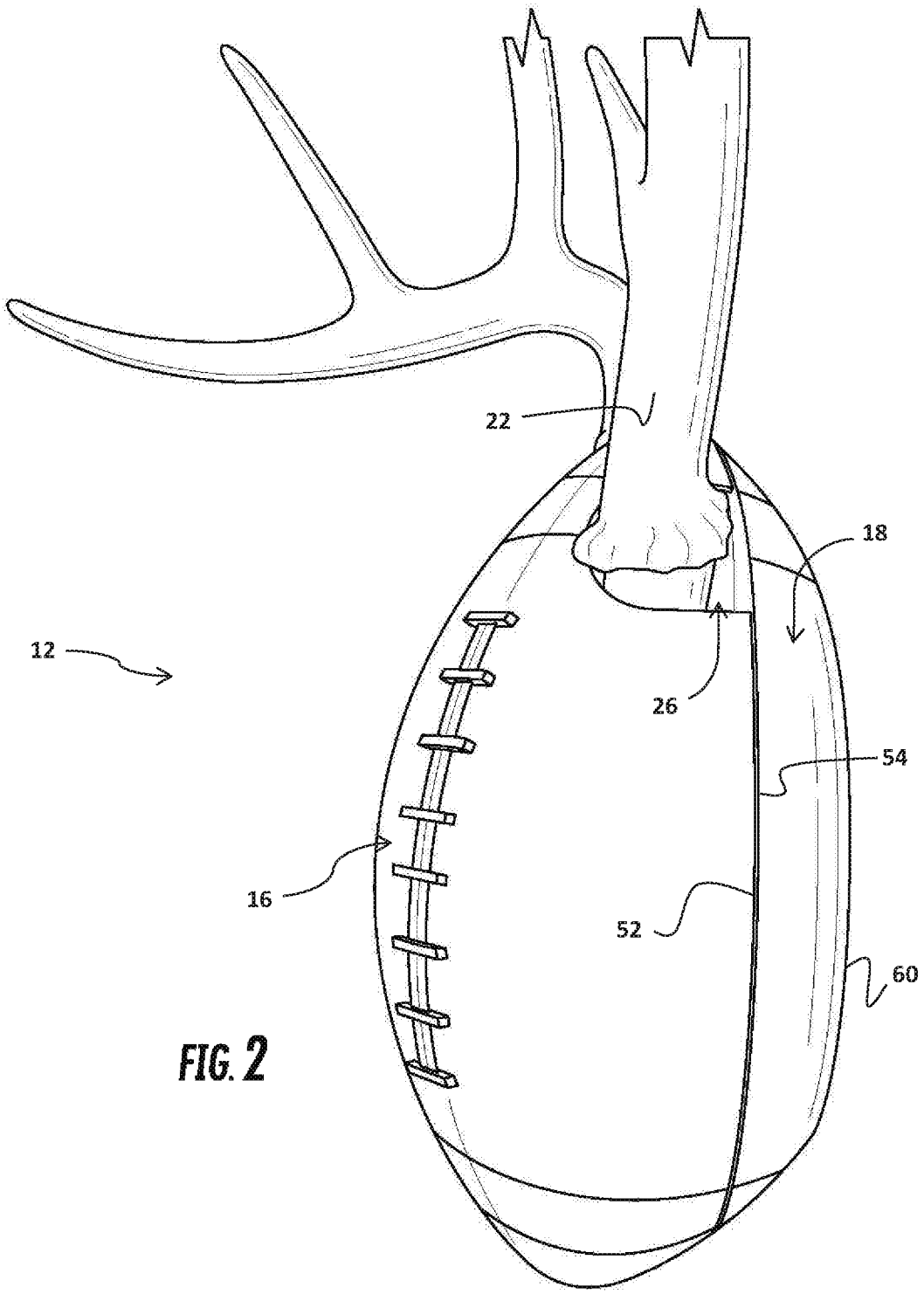
FIG. 2 is a side isometric view of the antler wall mounting assembly of FIG. 1.

As shown, for example, in FIGS. 1 and 2, in the preferred embodiment, the front portion 16 of the enclosure 14 comprises a rounded, generally hollow, fusiform configuration such that front portion horizontal diameters 82, 84, of top and bottom ends 30, 32 are narrower than a mid-point horizontal diameter 34. In the preferred embodiment, the front portion 16 comprises a lace-like extension portion 36 which simulates the laces of a standard American football. As shown in FIGS. 1 & 2, the lace-like extension portion 36 is formed from a series of raised segments 38, 40 generally arranged vertically 38 and horizontally 40 with respect to an outer surface of the front portion. In a preferred embodiment, the lace-like extension portion 36 extends vertically such that approximately half the vertical and horizontal raised segments 38, 40 are above the mid-point horizontal diameter 34 and half are below. In a preferred embodiment, the lace-like extension portion 36 is positioned to one side of center, as shown, for example, in FIG. 1. In other embodiments, the lace-like extension portion 36 is centrally positioned, such that the lace-like extension portion 36 is positioned below a mid-point between the lateral openings 26, 28.

In the preferred embodiment, the front portion 16 is formed from a hard material such as plastic. The lace-like extension portion 38 is formed from the same material and is integral to the remainder of the front portion 16. Though integrated within the front portion 16 in the preferred embodiment, the lace-like extension portion 36 extends outward from an outer surface 72 of the front portion 16 such that the lace-like extension portions 36 have a similar appearance as laces on a standard American football. In certain embodiments, simulated contrasting stripes 42, 44 are positioned near the respective ends 30, 32 of the front portion 16 to simulate the stripes of some standard footballs such as, for example, footballs used in college games. In some embodiments, simulated seams 46, 48 extend from, approximately, the top end 30 to the bottom end 32.

Although, the antler wall mount assembly 12 of preferred embodiments comprises a lace-like extension portion 36, contrasting stripes 42, 44, simulated seams, the assembly 12 need not comprise such lace-like extension portion 36, contrasting stripes 42, 44, and simulated seams. In other embodiments, for example, the assembly does not comprise simulated seams 46, 48 or stripes 42, 44.

Figure 6:
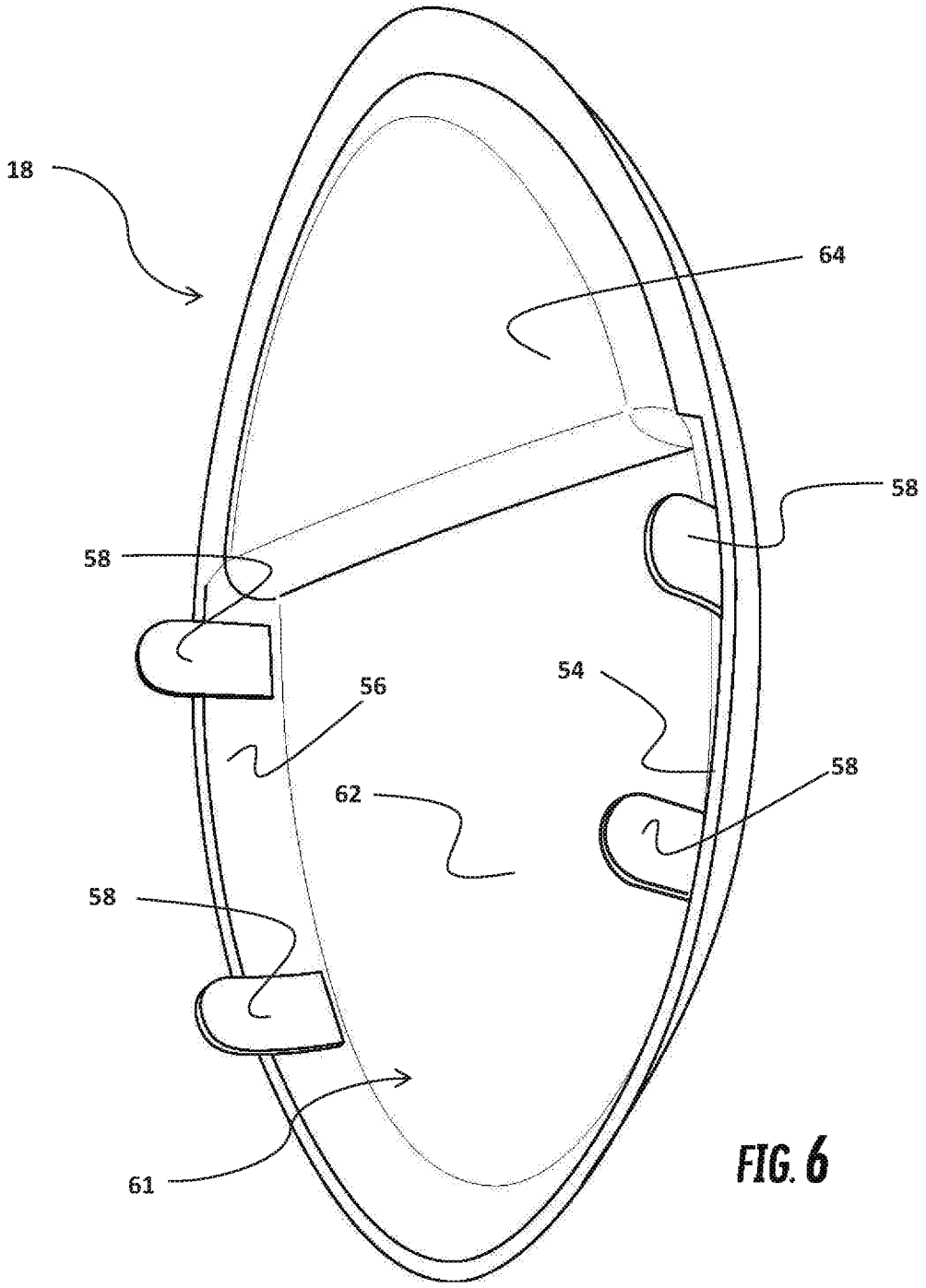
FIG. 6 is a side and front isometric view of a rear portion of the assembly in accordance with another embodiment.

Referring to FIG. 6, the front portion 16 comprises the lateral openings 26, 28. The lateral openings 26, 28 are positioned on sides of the front portion 16 proximate to the top end 30 and are adapted to permit the front portion 16 to partially enclose a lower perimeter 50 of the antler 24 main beams 22. Thus, the front and rear portions 16, 18 enclose the lower perimeter 60 when the antlers 24 are positioned within the enclosure 14 and the front and rear portions 16, 18 are secured together as shown in FIGS. 1 & 2.

Figure 3:
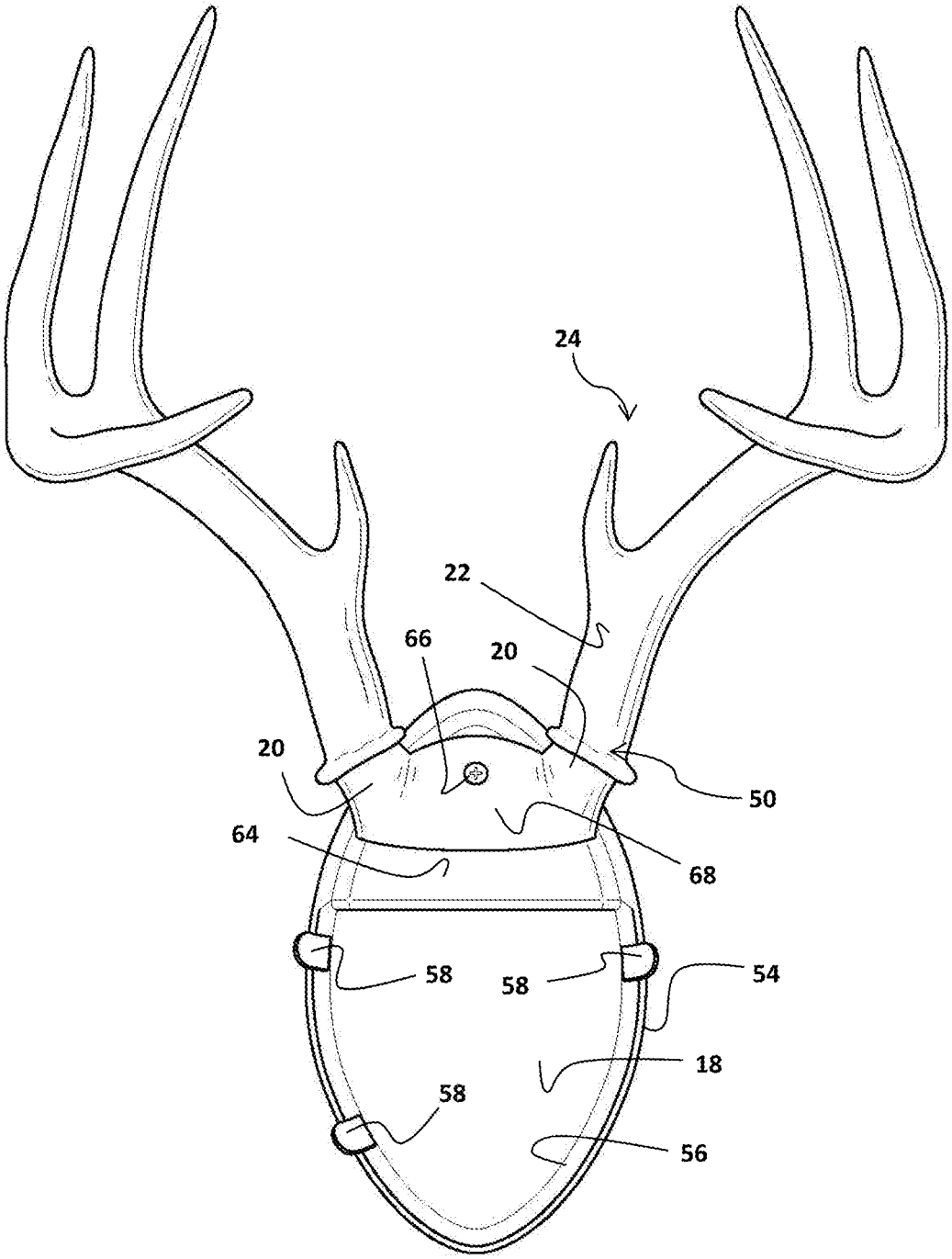
FIG. 3 is a front elevation view of a rear portion of the assembly of FIGS. 1 & 2, and showing the antlers in place.
Figure 4:
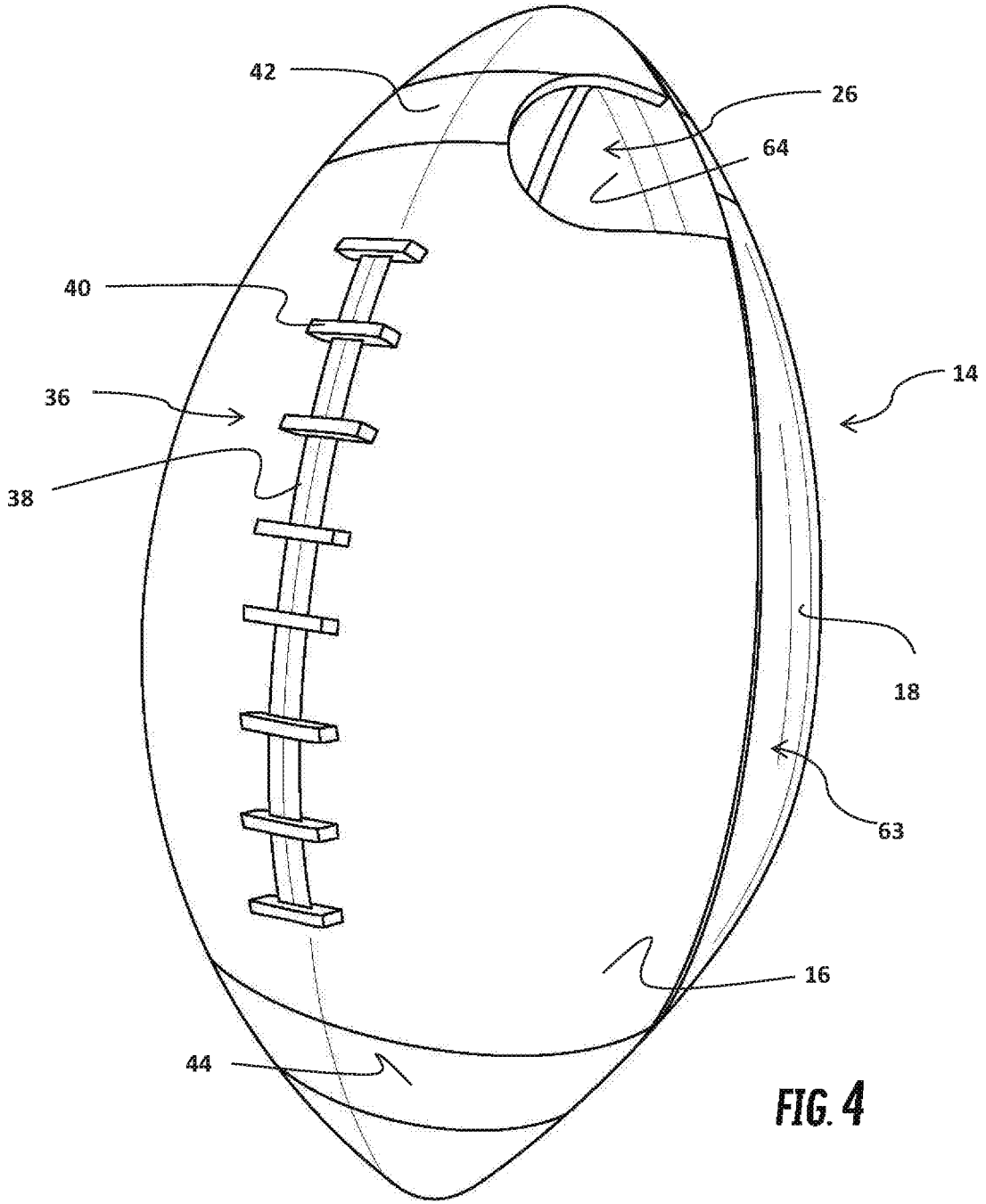
FIG. 4 is a side isometric view of the antler wall mounting assembly of FIG. 1 without the antlers in place.
Figure 5:
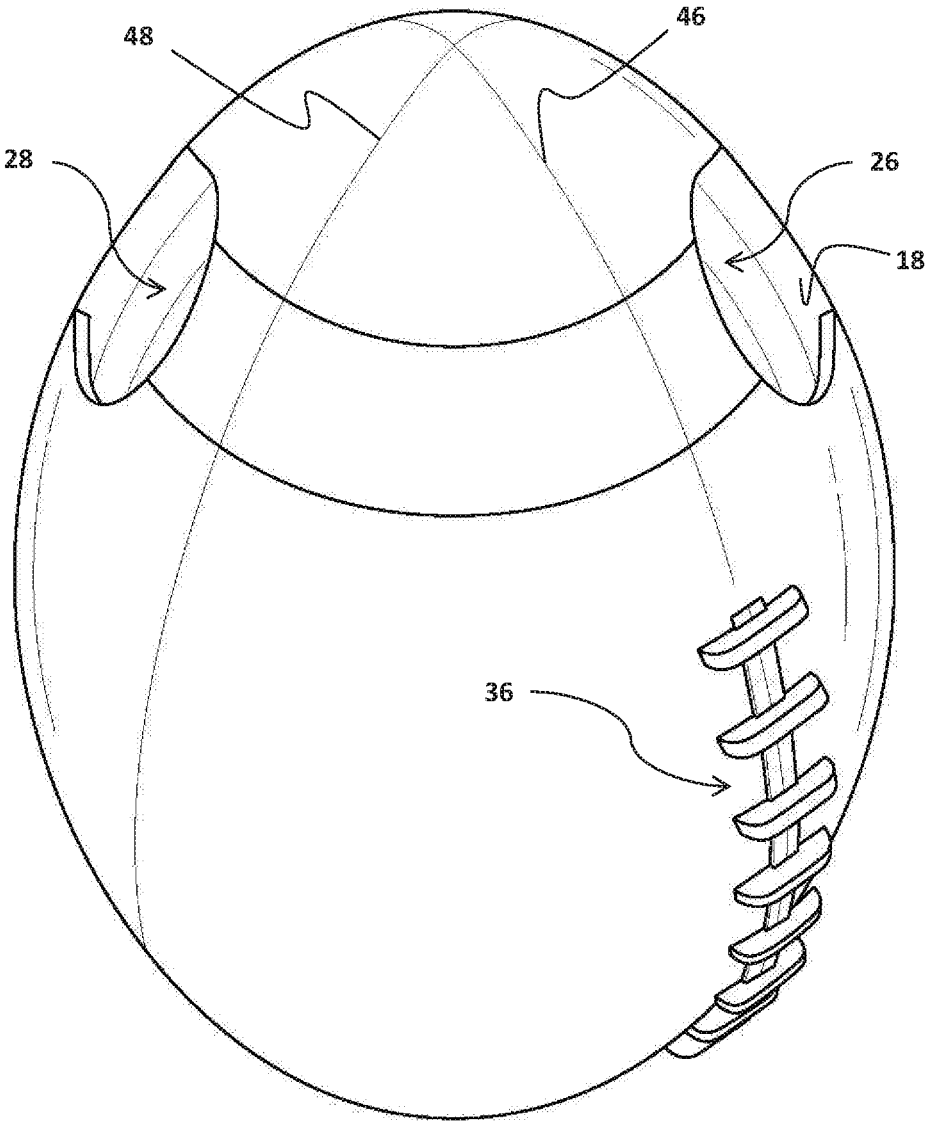
FIG. 5 is a front and top side isometric view of the antler wall mounting assembly of FIG. 1 without the antlers in place.
Figure 7:
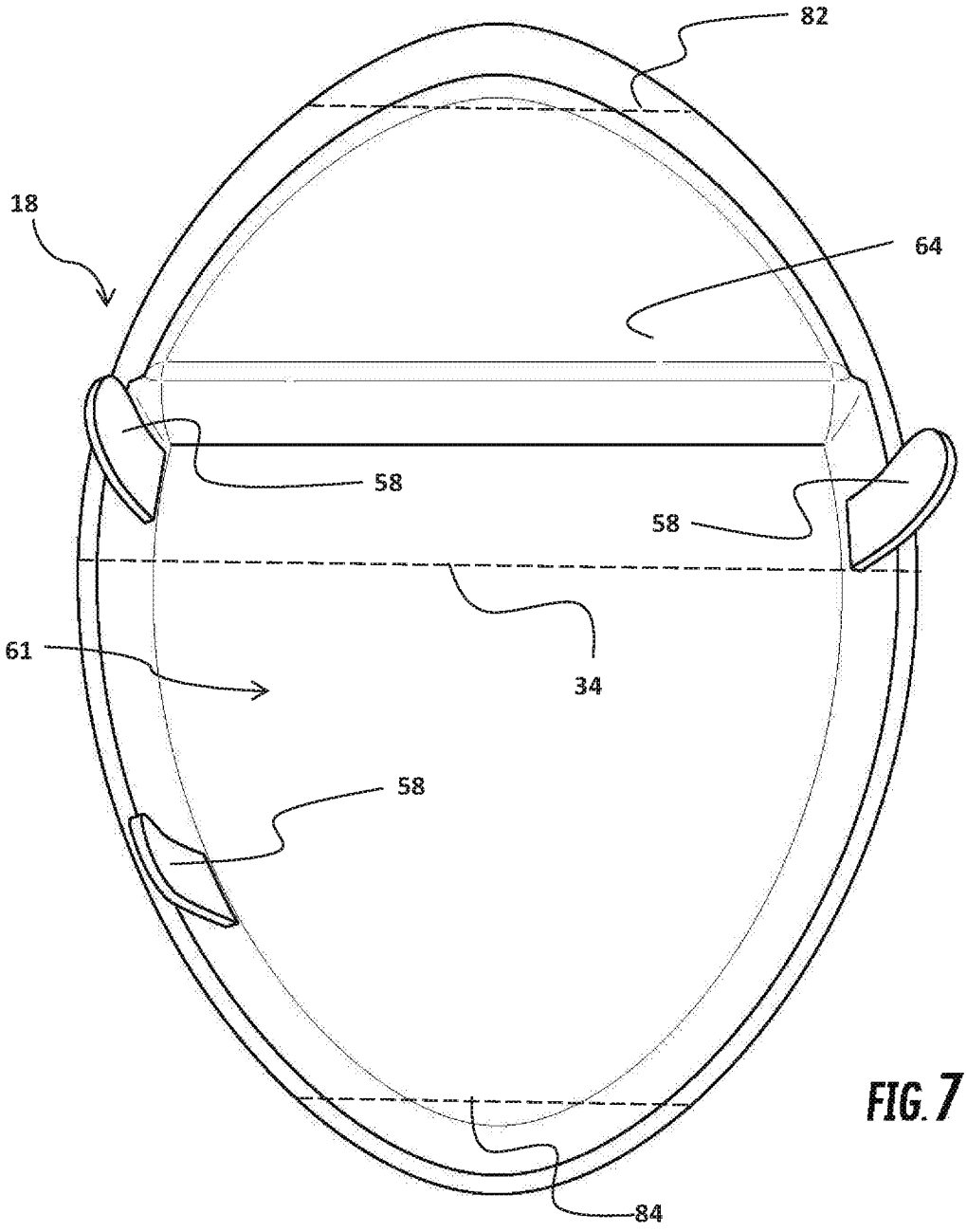
FIG. 7 is a front elevation view of a rear portion of the assembly of FIGS. 1 & 2, without the antlers in place.

Referring to FIGS. 2 & 3, and 7 the rear portion 18 comprises a rear portion outer rim 54 adapted for cooperative coupling with a front portion outer rim 52. In the preferred embodiment, the rear portion outer rim 54 comprises an oval configuration such that, as depicted in FIG. 7, the rear portion 18 shares the same upper and lower end horizontal diameters 82, 84 and mid-point horizontal diameter 34 as the front portion 16. Except for those portions of the front portion outer rim 52 comprising lateral openings 26, 28, the outer rims 52, 54 of the front and rear portions 16, 18 are generally the same shape and size so as to permit the front and rear portions 16, 18 to be coupled together and give the appearance that the rear portion 18 is a continuation of the front portion 16.

Extending forward from an angled inside perimeter wall 66 of the rear portion 18 are one or more tabs 58. Each tab 68 is flexible and biased exterior to the respective side of the perimeter wall 66 to which the tab 68 is mounted. The user can bend the tabs 658 inwardly so as to permit the front portion outer rim 52 to be moved against the rear portion outer rim 64. When released, the tabs 58 return to the exteriorly biased position. When the front portion 16 is mounted to the rear portion 18, the tab's 58 exterior bias applies pressure on an inside surface of the front portion 16, keeping the front and rear portions 16, 18 firmly coupled together. In other embodiments, the tabs 58 are coupled to, and extend from, the inside surface of the front portion 16, engaging the rear portion 18 perimeter wall 66 and securing the front 16 and rear portion 18 together.

Figure 15:
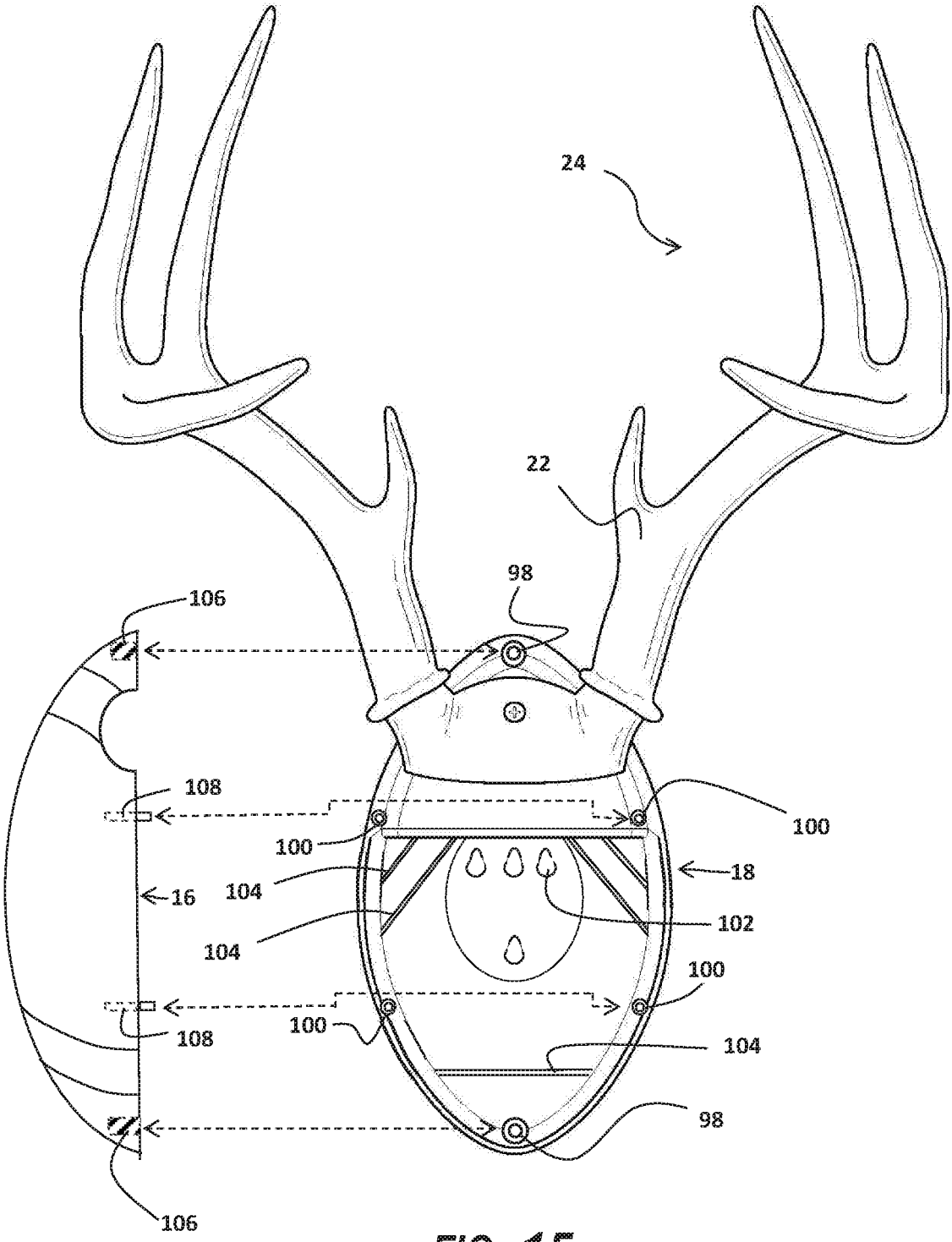
FIG. 15 is a front elevation view of a rear portion of the assembly of FIGS. 1 & 2, in accordance with another embodiment.

In the preferred embodiment, there are four tabs 58, as shown in FIG. 6. However, there can be more or fewer tabs 58. For example, in other preferred embodiments, there are three tabs 58, as shown in FIGS. 3 and 7. Although tabs 58 are used to removably couple the front and rear portions 16, 18 together, other fastening mechanisms known in the art may also be used. For example, the front and rear portions 16, 18 may be coupled together with conventional and commercially available fasteners such as glue, snaps, hook and loop fasteners, threaded couplers (screws, bolts, etc.), pins, detents, and the like. For example, as shown in FIG. 15, in some embodiments, the front portion 16 is coupled to the rear portion 18 with dowels 108 adapted to be inserted into dowel receiver portions 100 in combination with screws inserted through respective rear screw bosses 98, 98 and threaded screw receive portions 106, 106 positioned in the front portion 16.

The rear portion 18 comprises a generally flat rear outer surface 60 which permits the assembly 12 to be easily mounted against a flat wall using standard mounting hardware such as hooks, wires, cleats, nails, screws, and the like. In some embodiments, such as that which is shown in FIG. 16, the rear portion comprises one or more tear drop shaped through openings 102 adapted to receive a hook, nail or other fastener. In some embodiments, the rear portion 18 comprises reinforcement ribs 104. These ribs 104 help provide stability to the structure.

The inside perimeter wall 56 defines an inside surface 61 comprising a rear wall 62 and the interior shelf 64. In the preferred embodiment, the interior shelf 64 is raised with respect to the inside rear wall 62 such that, when the rear portion 18 is mounted to the front portion 16, the interior shelf 64 is closer to the front portion 16 than the inside rear wall 62. This interior shelf 64 is the surface to which the antlers 24 are mounted. In the preferred embodiment, the interior shelf 64 is adapted to receive a threaded fastener 66 which is driven through the mounting member 68 of the antlers 24. The mounting member 68 can be artificial or natural. The mounting member 68, for example, may comprise the skull portion to which the antlers 24 are naturally attached. With respect to sheds, the mounting member 68 may comprise wood, plastic, or other suitable material adapted to permit the main beams 22 to be attached. Although in the preferred embodiment, the inside perimeter wall 56 defines an inside rear wall 62 and the interior shelf 64, the assembly 12, need not comprise an interior shelf 64. Rather, the inside rear wall 56 can extend to the entire area within the inside perimeter wall 56.

Figure 8:
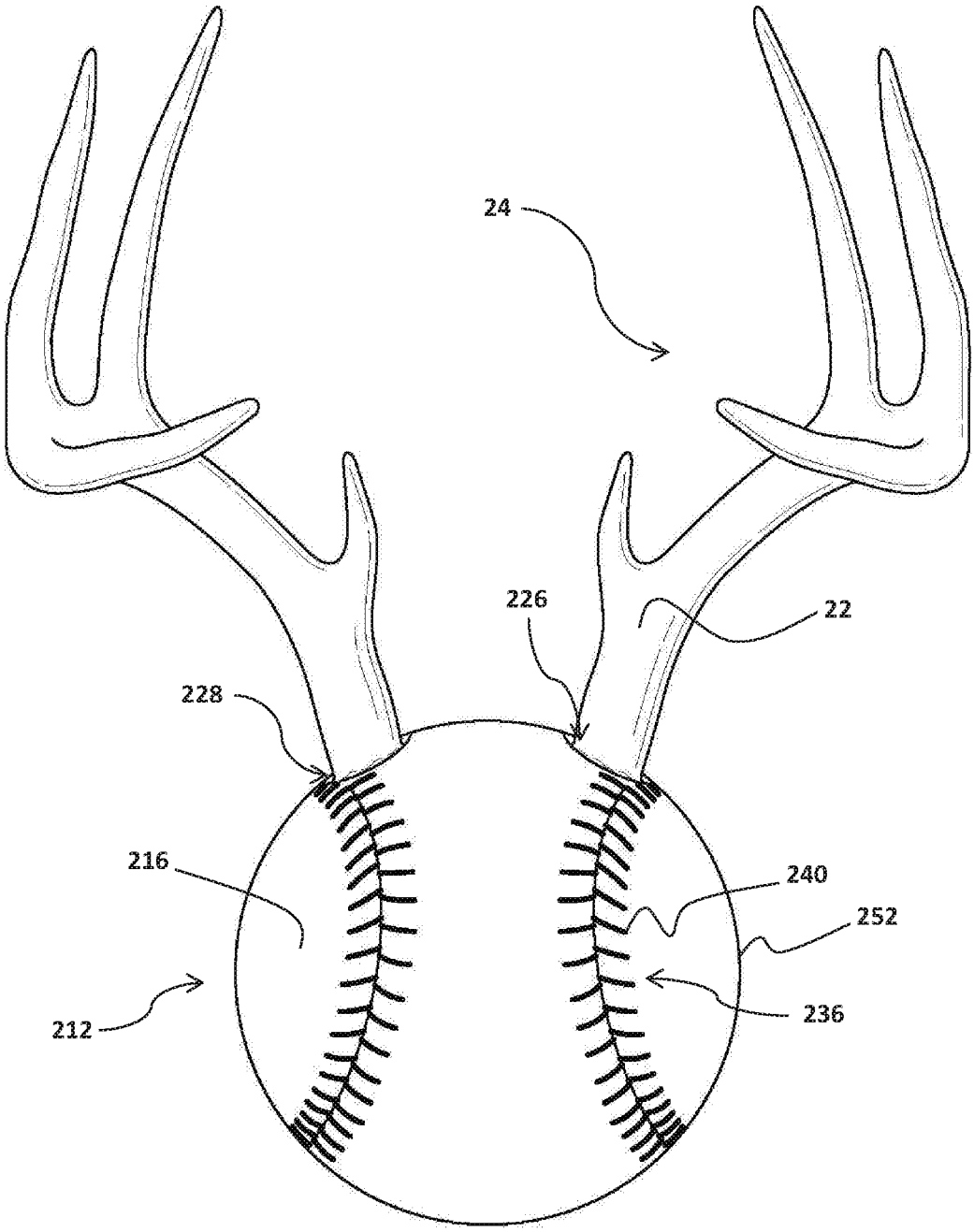
FIG. 8 is a front elevation view of the antler wall mounting assembly, in accordance with another embodiment.
Figure 9:
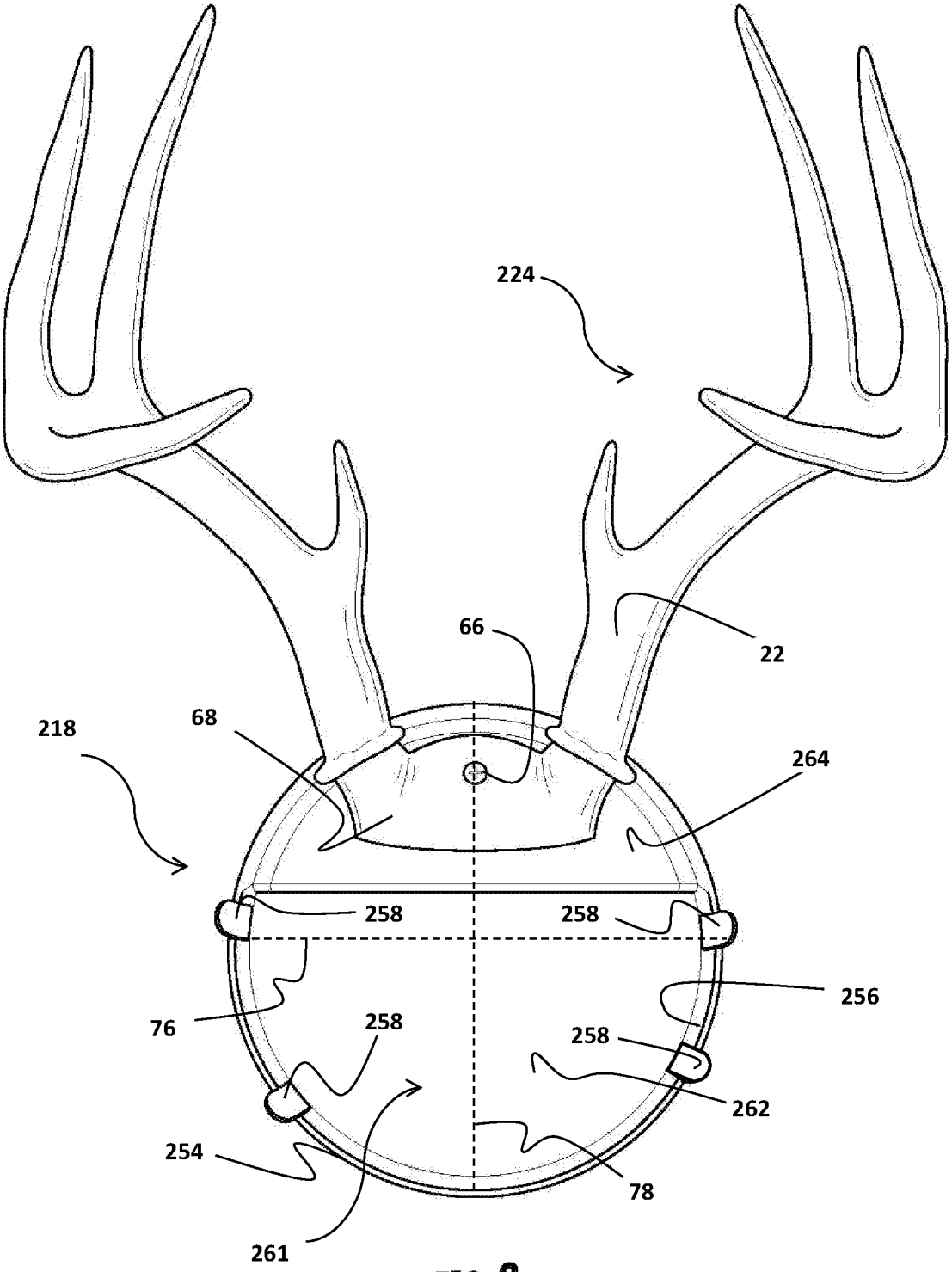
FIG. 9 is a front elevation view of a rear portion of the assembly of FIG. 8 showing the antlers in place.
Figure 10:
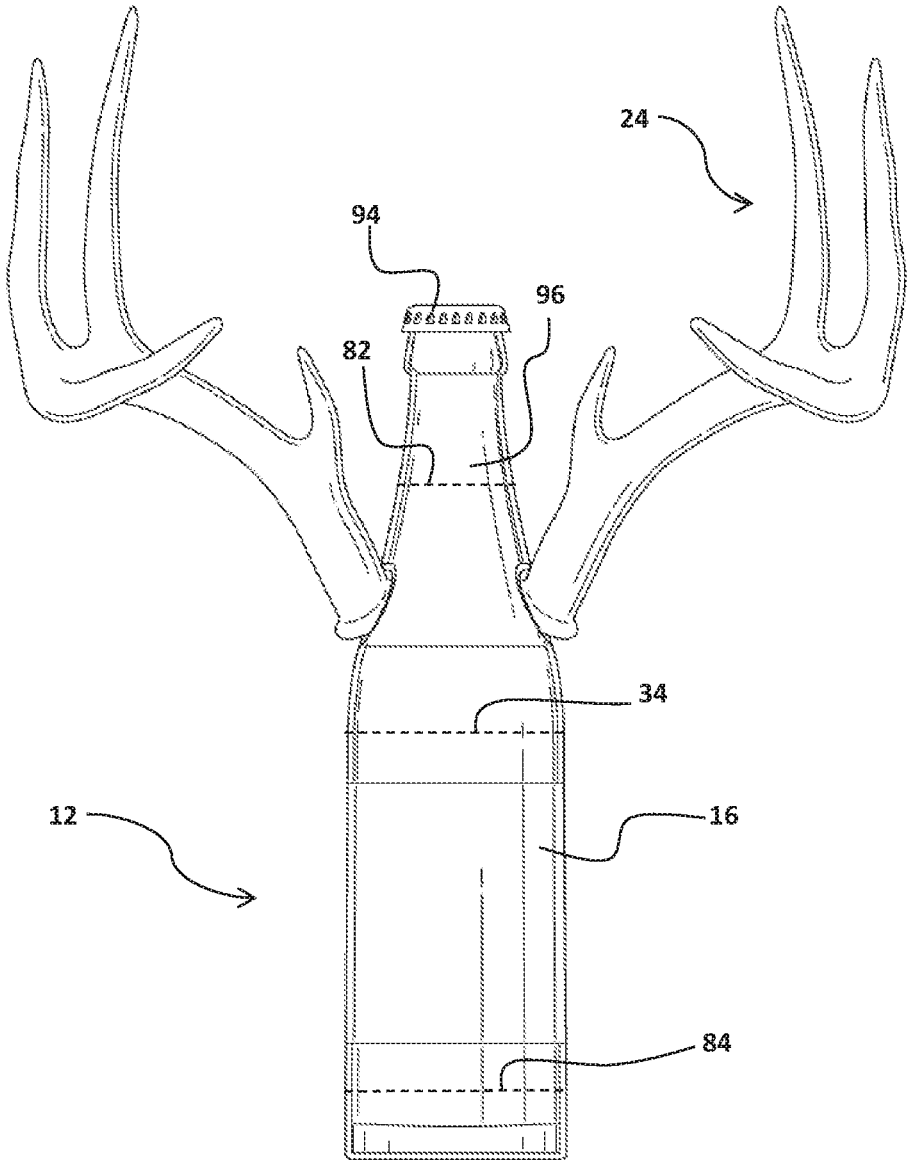
FIG. 10 is a front elevation view of the antler wall mount assembly, in accordance with another embodiment.
Figure 11:
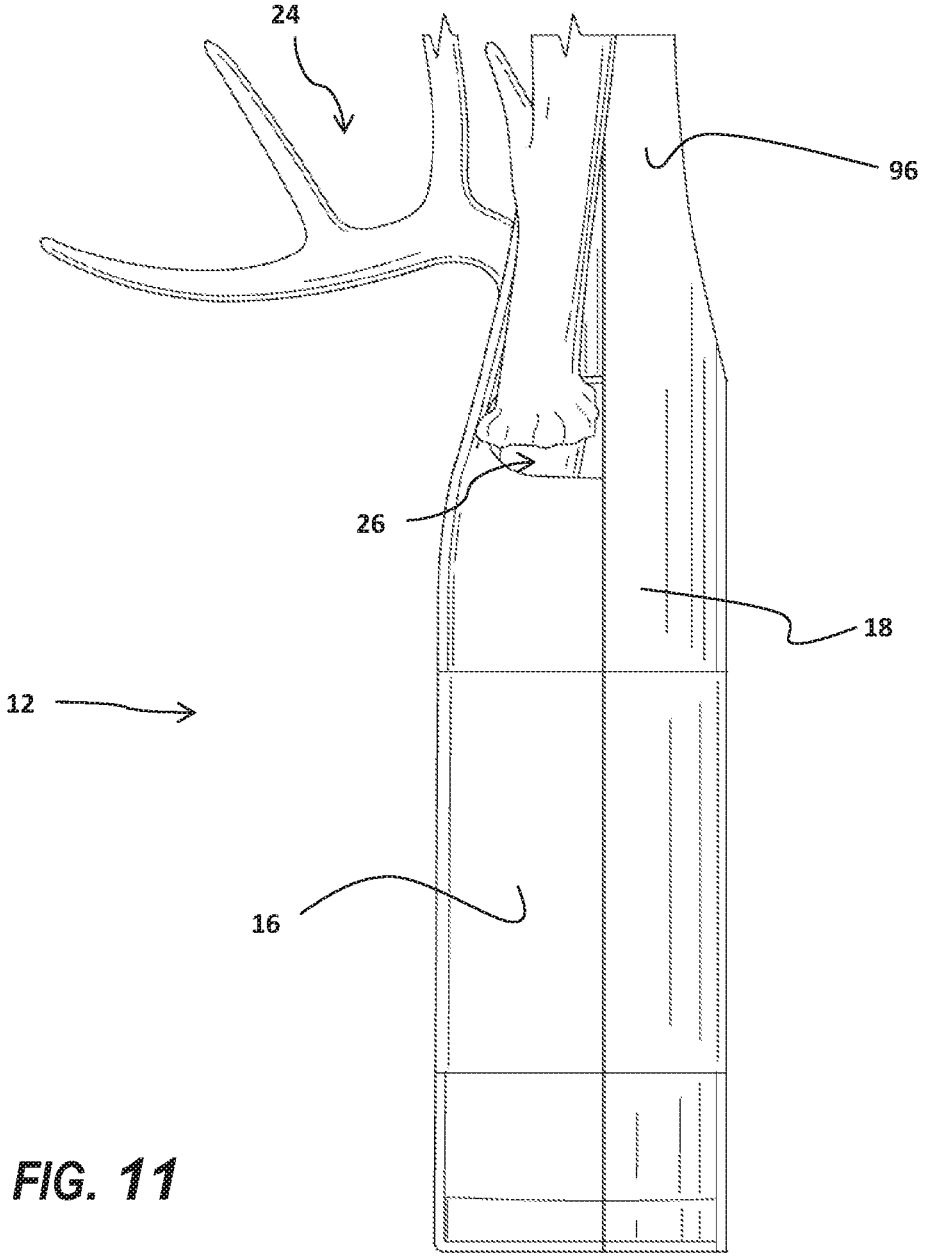
FIG. 11 is a side isometric view of the antler wall mounting assembly of FIG. 10.
Figure 12:
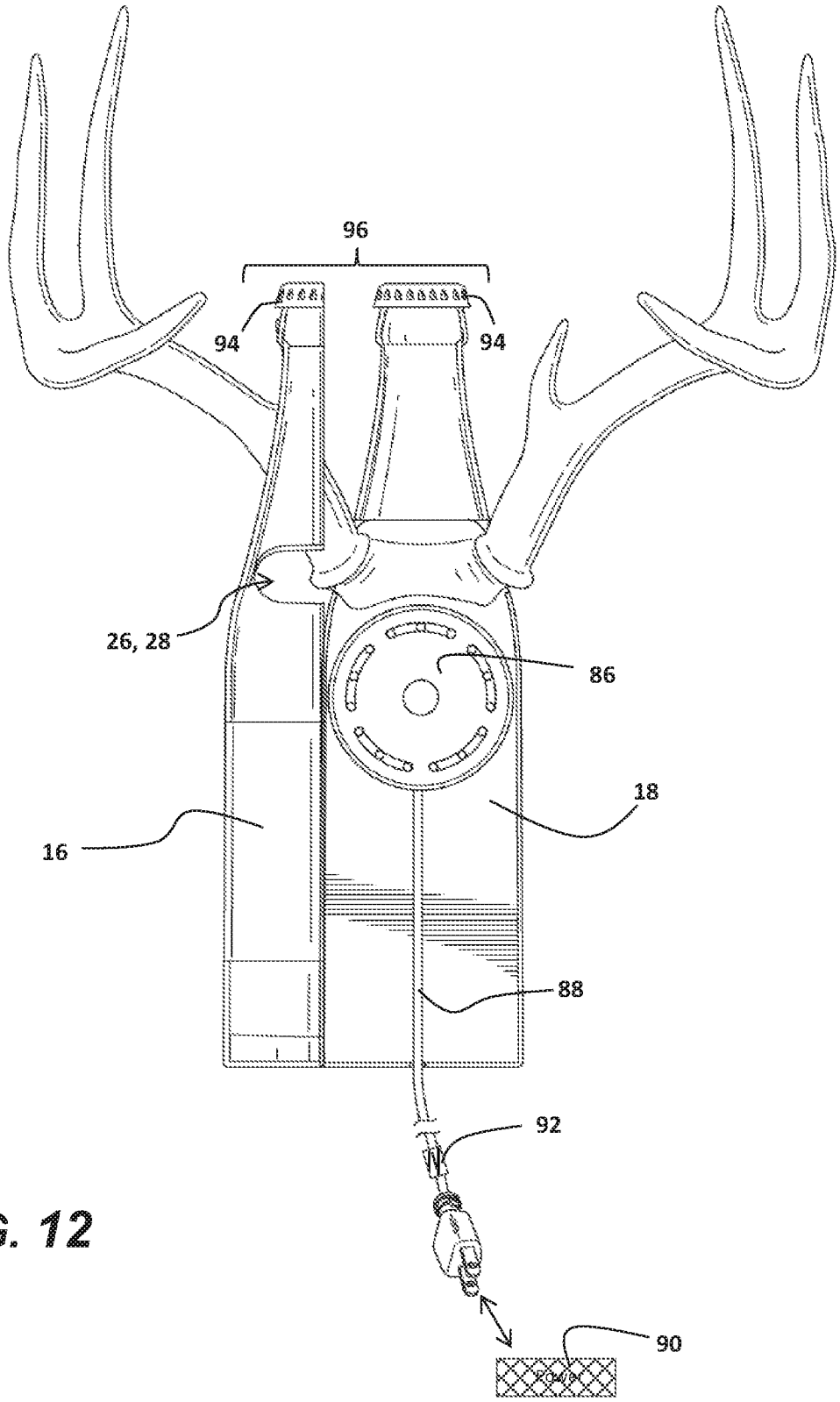
FIG. 12 is a front elevation view of a rear portion of the assembly of FIGS. 10 & 11 showing the antlers in place along with a light source, in accordance with another embodiment.

Referring to FIGS. 8 and 9, in another embodiment, the front portion 216 of the enclosure 14 comprises a rounded, generally hollow, semi-spheroid configuration resembling a baseball. In this embodiment, the outer rim 262 comprises a circular configuration when viewed from the front, such that as depicted in FIG. 9, a rear portion mid-point vertical diameter 78 is approximately equal to a rear portion mid-point horizontal diameter 76.

In this embodiment, the front portion 216 comprises simulated stitching 236 which simulates the stitching of a standard baseball. The simulated stitching 236 of this embodiment is formed from a series of simulated stitches 240.

Referring to FIG. 9, the rear portion 218 of this embodiment comprises a circularly configured rear portion outer rim 264 (when viewed from the front) adapted for cooperative coupling with a front portion outer rim 252 (FIG. 8). Except for those portions of the front portion outer rim 262 comprising through openings 226, 228, the outer rims 262, 254 of the front and rear portions 216, 218 are generally the same shape and size so as to permit the front and rear portions 216, 218 to be coupled together and give the appearance that the rear portion 218 is a continuation of the front portion 216.

Extending forward from an angled inside perimeter wall 256 of the rear portion 218 are one or more tabs 258. Each tab 258 is flexible and biased exterior to the respective side of the perimeter wall 256 to which the tab 258 is mounted. The user can bend the tabs 258 inwardly so as to permit the front portion outer rim 252 to be moved against the rear portion outer rim 254. When released, the tabs 258 return to the exteriorly biased position. When the front portion 216 is mounted to the rear portion 218 the tab's 2568 exterior bias applies pressure on an inside surface of the front portion 216, keeping the front and rear portions 218, 218 firmly coupled together.

In the preferred embodiment, there are four tabs 58, as shown in FIG. 6. However, there can be more or fewer tabs 58. For example, in other preferred embodiments, such as that shown in FIG. 7, there are three tabs 58. Referring to the embodiment shown in FIGS. 8 and 9, there are four tabs 258 (FIG. 9). Although such tabs 258 depicted in FIG. 9 are used to removably couple the front and rear portions 216, 218 together, other fastening mechanisms known in the art may also be used. For example, the front and rear portions 216, 218 may be coupled together with conventional and commercially available fasteners such as glue, snaps, hook and loop fasteners, threaded couplers (screws, bolts, etc.), pins, detents, and the like.

The rear portion 218 of this embodiment comprises a generally flat rear outer surface (not shown) which permits the assembly 212 to be easily mounted against a flat wall using standard mounting hardware such as hooks, wires, cleats, nails, screws, and the like.

The inside perimeter wall of this embodiment 256 defines an inside rear surface 261 comprising an inside rear wall 262 and interior shelf 264. The interior shelf 264 is raised with respect to the inside rear wall 262 such that, when the rear portion 218 is mounted to the front portion 216, the interior shelf 264 is closer to the front portion 216 than the inside rear wall 262. This interior shelf 264 is the surface to which the antlers 224 are mounted. In the preferred embodiment, the interior shelf 264 is adapted to receive the threaded fastener 66 which is driven through the mounting member 68 of the antlers 24.

In other embodiments, the assembly 12 comprises a soccer ball configuration when viewed from the front. In other embodiments, when viewed from the front, the assembly 12 comprises respective configurations of a basketball, a tennis ball, a hockey puck, a golf ball, a volley ball, a bowling pin, and a billiards ball.

As shown, for example, in FIGS. 10-14, in other embodiments, the assembly 12 comprises a long neck style drinking bottle or a liquor bottle configuration comprising a neck 96. In preferred embodiments, the assembly 12 may include a light source 86 powered by a power source 90 such as a battery or ac or dc power source, through, for example, a power cord 88. In the preferred embodiment, the light source 86 is a conventional and commercially available low voltage AC powered LED "puck" style light. As incoming voltage from a household electrical outlet is typically 120 volts, a conventional and commercially available transformer (not shown) may be incorporated to supply the desired voltage to the light source 86. In a preferred embodiment, the light source is mounted to the rear portion 18. However, the light source 86 can be mounted in other positions within the enclosure 14 or exterior to the enclosure 14.

In preferred embodiments, the front and/or rear portions 16, 18 are partially or entirely formed from a translucent or transparent material such that light emitted from the light source 86 can pass through the front and or rear portions 16, 18. In preferred embodiments, the enclosure 14 comprising a light source 86 comprises a switch 92 external to the enclosure 14 such that the light source 86 can be activated without opening the enclosure 14. The switch 92 is positioned within the enclosure 14 in other embodiments.

In some embodiments comprising a bottle configuration, the assembly comprises a cap 94. In some embodiments, the cap 94 is removably coupled to the front and or rear portions 16, 18.

Figure 13:
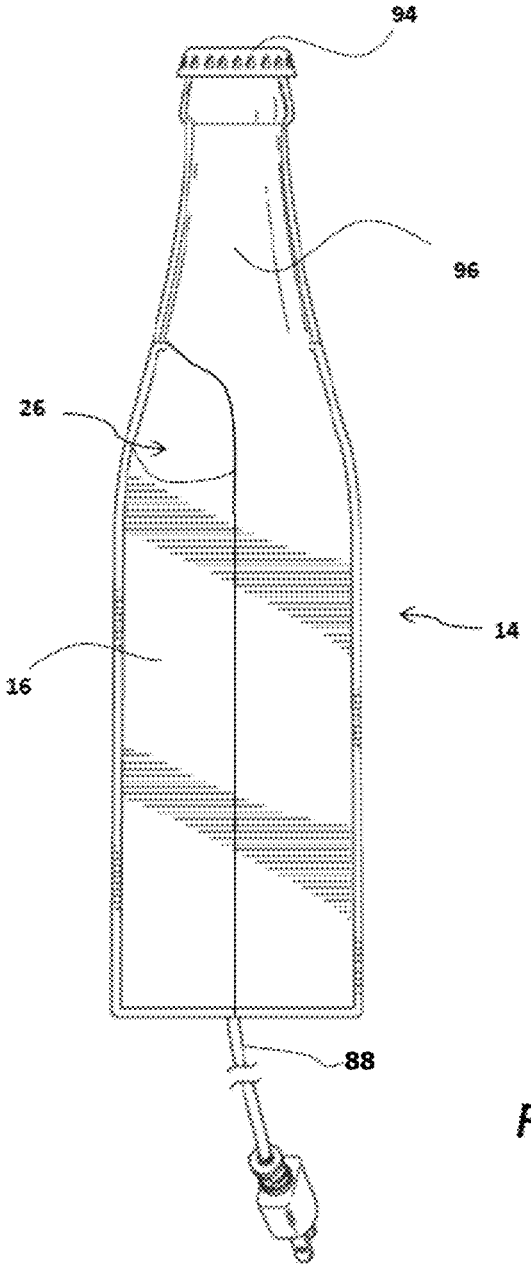
FIG. 13 is a side view of the antler wall mounting assembly without the antlers in place, in accordance with another embodiment.
Figure 14:
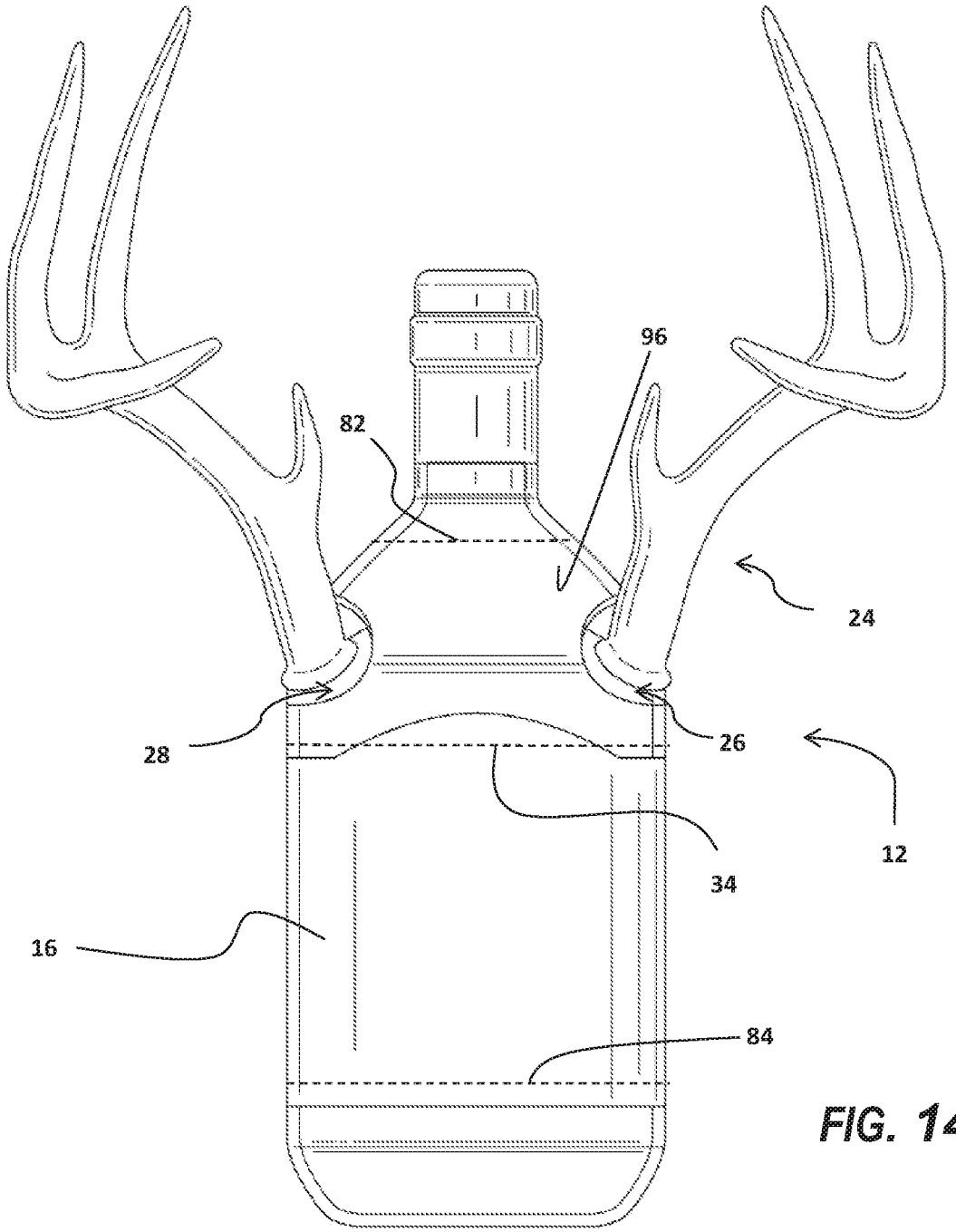
FIG. 14 is a front view of the antler wall mounting assembly with the antlers in place in accordance with another embodiment.

Referring to FIG. 13, in some embodiments comprising a bottle configuration, the rear portion 18 comprises all or most of the neck portion 96. In other embodiments (FIGS. 10-12), the rear portion 18 comprises the rear portion of the neck 96 and the front portion 16 comprises the front portion of the neck 96. In some embodiments comprising a bottle configuration, the front portion 16 comprises the entire neck portion 96.

A method of mounting is provided. The method comprises the steps of: providing a set of antlers 24 comprising first and second main beams 22; providing an enclosure 14 comprising a front portion 16 and a rear portion 18, the front portion 16 comprising first and second lateral openings 26,28; the front and rear portions 16,18 sharing upper and lower end horizontal diameters 82,84 and a mid-point horizontal diameter 34; the upper and lower end horizontal diameters 82,84 having lengths that are shorter than a length of the mid-point horizontal diameter 34; the rear portion 18 comprising an inside surface 61 and an outside surface 63, coupling an end portion of the first main beam 22 to a mounting member 68; coupling an end portion of the second main beam to the mounting member 68; coupling the mounting member 68 to the inside surface 61; and coupling the front portion 16 to the rear portion 18 such that the first main beam 22 extends through the first lateral through opening 26 and the second main beam 22 extends through the second lateral opening 28.

In other embodiments of the method, the front and rear portions 16, 18 each comprise an outer rim 52,64, the front portion outer rim 52 being co-planar with the rear portion outer rim 54 when the front and rear portions 16,18 are coupled together.

In other embodiments of the method, the front portion outer rim 52 defines a hollow space, such that the front portion 16 comprises a cupped configuration.

In other embodiments of the method, the front portion 16 comprises an outer surface 72 and a lace-like extension portion 36, the lace-like extension portion 36 extending outward from the front portion outer surface 72.

In other embodiments of the method, the raised portion 36 comprises generally vertically and horizontally arranged segments 38, 40.

In other embodiments of the method, the rear portion 18 comprises a generally flat rear outer surface 60 and the method further comprises the step of coupling the flat rear outer surface 60 to a wall.

In other embodiments of the method, the rear portion 18 comprises an inside perimeter wall 56 defining an inside rear wall 62 and an interior shelf 64, the interior shelf 64 being raised with respect to the inside rear wall 62.

In other embodiments of the method, the enclosure 14 comprises tab portions 58, the tab portions 58 being biased outward such that when the front portion 16 is coupled to the rear portion 18, the tab portions 68 exert pressure on an opposing surface.

In other embodiments of the method, the enclosure 14 comprises a midpoint vertical diameter 78, the midpoint vertical diameter 78 comprising a length equal to the length of the midpoint horizontal diameter 76.

In other embodiments of the method, the enclosure 14 comprises a bottle configuration.

In other embodiments of the method, the enclosure 14 comprises a light source 88.

In the preferred embodiment, the assembly 12 is formed from plastic. However, the assembly may be formed from other suitable materials such as wood, The components of certain embodiments of the device 12 may comprise other natural or man-made suitable materials, such as metals, glass, or materials formed from a variety of polymers, monomers, co-polymers, polyethylene, polypropylene, polyvinyl chloride, polytetrafluoroethylene (PTFE) or other suitable synthetic material, without departing from the scope and spirit of this disclosure.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

We claim:

1. An antler wall mount assembly comprising:

an enclosure comprising a front portion and a rear portion;

the front portion comprising a shape comprising a semi-cylindrical body portion and a narrower neck portion;

the enclosure comprising first and second lateral through openings;

the rear portion comprising an inside surface and an outside surface, the outside surface being adapted for removable coupling to a generally flat structure;

the inside surface being adapted to couple, directly or indirectly, end portions of first and second main beams of antlers, such that, when coupled to the inside surface, the first main beam extends through the first lateral through opening and the second main beam extends through the second lateral through opening;

the enclosure front and rear portions being structured and arranged for removable coupling to one another;

the rear portion comprising an inside perimeter wall defining an inside rear wall;

the rear portion further comprising an interior shelf, the interior shelf being raised with respect to the inside rear wall; and the front and rear portions each comprising an outer rim, the front portion outer rim being co-planar with the rear portion outer rim when the front and rear portions are coupled together.

2. The antler wall mount assembly of claim 1, the front portion outer rim defining a hollow space, such that the front portion comprises a cupped configuration.

3. The antler wall mount assembly of claim 1, the rear portion comprising a generally flat rear outer surface.

4. The antler wall mount assembly of claim 1, the enclosure comprising tab portions, the tab portions being biased outward such that when the front portion is coupled to the rear portion, the tab portions exert pressure on an opposing surface.

5. The antler wall mount assembly of claim 1 wherein the enclosure further comprises an interior light source.

6. A method of mounting antlers, the method comprising the steps of:

providing a set of antlers comprising first and second main beams coupled to a mounting member;

providing an enclosure comprising a front portion and a rear portion, the enclosure comprising first and second lateral through openings;

the front portion comprising a shape comprising a semi-cylindrical body portion and a narrower neck portion;

the rear portion comprising an inside surface and an outside surface;

the rear portion comprising an inside perimeter wall defining an inside rear wall;

the rear portion further comprising an interior shelf, the interior shelf being raised with respect to the inside rear wall;

coupling the mounting member to the inside surface; and coupling the front portion to the rear portion such that the first main beam extends through the first lateral through opening and the second main beam extends through the second lateral through opening.

7. The method of mounting antlers of claim 6 wherein:

the front and rear portions each comprise an outer rim, the front portion outer rim being co-planar with the rear portion outer rim when the front and rear portions are coupled together.

8. The method of mounting antlers of claim 7 wherein:

the front portion outer rim defines a hollow space, such that the front portion comprises a cupped configuration.

9. The method of mounting antlers of claim 8, wherein the rear portion comprises a generally flat rear outer surface and the method further comprises the step of:

coupling the flat rear outer surface to a wall.

10. The method of mounting antlers of claim 6 wherein:

the enclosure comprises tab portions, the tab portions being biased outward such that when the front portion is coupled to the rear portion, the tab portions exert pressure on an opposing surface.

* * * * *